United States Patent [19]

Ivy

[11] 4,017,016

[45] Apr. 12, 1977

[54] SHIPPING CONTAINER FOR PERISHABLES

[75] Inventor: Orval D. Ivy, Fort Smith, Ark.

[73] Assignee: IWN, Inc., Fredonia, Kans.

[22] Filed: Mar. 1, 1976

[21] Appl. No.: 662,804

[52] U.S. Cl. ..... 229/23 BT; 229/14 H; 206/523

[51] Int. Cl.[2] ..... B65D 13/00; B65D 5/56

[58] Field of Search ..... 229/14 H, 14 C, 23 BT; 206/523; 220/9 F

[56] References Cited

UNITED STATES PATENTS

| | | | |
|---|---|---|---|
| 3,006,780 | 10/1961 | Shaffer | 229/14 H |
| 3,142,431 | 7/1964 | Noble | 229/23 BT |
| 3,344,973 | 10/1967 | Studen | 206/523 UX |
| 3,465,948 | 9/1969 | Boyer | 229/14 H |
| 3,542,282 | 11/1970 | Troth | 206/523 |
| 3,625,785 | 12/1971 | Holmstrom | 229/14 H |
| 3,867,874 | 2/1975 | O'Neil | 206/523 |
| 3,890,762 | 6/1975 | Ernst et al. | 229/14 C |

*Primary Examiner*—Davis T. Moorhead
*Attorney, Agent, or Firm*—Head, Johnson & Chafin

[57] ABSTRACT

An improved shipping container including a body formed of a flat elongated rectangular sheet of corrugated paper board, the sheet being scored so as to be folded into an upright open bottom and open top body enclosure, the interior surface of the body being covered by a foam sheet plastic material, and an upper and lower cover, each formed of a planar sheet of corrugated paper board, each cover having a rectangular central area of a dimension equal to the open end of the body enclosure and each cover having end flaps and side flaps, the width of the flaps being equal to one-half the height of the body enclosure, the center area of each cover being covered with sheet foam plastic material, the container being assembled so that the flat portions of the top and bottom covers are glued to the exterior surface of the body enclosure to form double wall sides on the assembled box, all interior surfaces of the box being covered by sheet foam plastic material.

1 Claim, 5 Drawing Figures

SHIPPING CONTAINER FOR PERISHABLES

BACKGROUND, SUMMARY AND OBJECTS OF THE INVENTION

Containers for shipping food have for many years been constructed of corrugated paper board. In recent years there has been much effort exerted towards the development of an inexpensive, sturdy container having good insulative characteristics and water retaining capabilities for use in shipping perishable food products. A particular problem exists in the design of a container of this type for use in shipping dressed poultry. Poultry products are normally shipped in refrigerated trucks, however, as an added safety precaution, containers of dressed poultry are usually packaged with ice so that while moving into and out of refrigerated shipping facilities, or in the event of short term loss of refrigerating capabilities of the shipping facilities, the temperature of the poultry products within the container is maintained sufficiently low to prevent bacterial action.

Others have devised shipping containers for this purpose, but all are expensive or have problems of one kind or another. The present invention is directed towards providing an improved shipping container of corrugated paper board which requires a minimum amount of paper board to obtain maximum container strength. In addition, the invention provides a container having high insulative characteristics while utilizing a minimum amount of insulating material.

It is therefore an object of this invention to provide an improved shipping container. More particularly, an object of this invention is an improved container for shipping perishables at a minimum expense while attaining a high degree of strength and durability.

These general objects as well as other and more specific objects of the invention will be fulfilled in the following description and claims, taken in conjunction with the drawings.

DESCRIPTION OF THE VIEWS

In FIG. 1 the body portion is shown with the insulating material applied.

SUMMARY OF THE INVENTION

The invention includes a container formed of three parts, the first part being a body portion and the other parts being a top and bottom portion which are identical. The body portion is cut initially in the shape of an elongated rectangular sheet of corrugated paper board with score lines therein so that it may be folded into a rectangular upright opened top and opened bottom container. The top and bottom covers are initially cut from a sheet of flat corrugated paper board. Each has a rectangular center area which conforms in size to the opened top and opened bottom of the body portion. Extending from the center area are end flaps and side flaps, each of a width so that when the top and bottom portions are assembled on the body, the flaps meet to provide a double thickness wall around the total perimeter of the body. The interior of the container is covered by sheet foam plastic. The entire container is assembled from the three basic components by adhesive.

DETAILED DESCRIPTION

Figure 1:
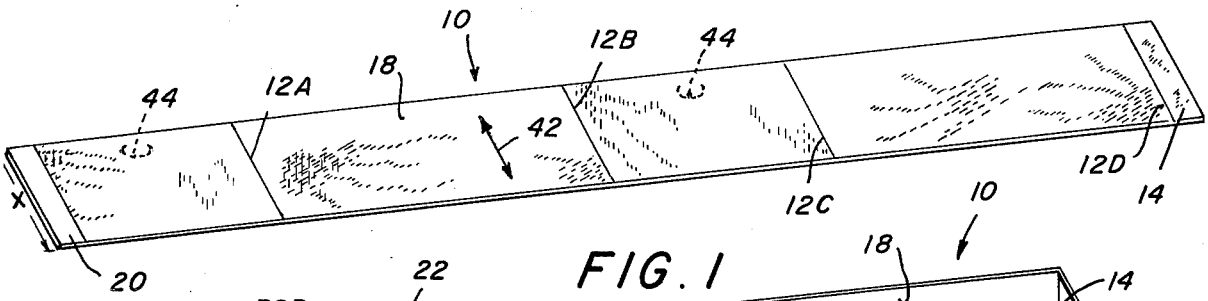
FIG. 1 is an isometric view of the body potion of the container as cut initially from a sheet of flat corrugated paper board and showing scoring lines wherein the body portion can be bent to form an upright open top and bottom container.

Referring to the drawings, a preferred embodiment of the invention is illustrated. The container includes three basic portions, two of which are identical. All portions of the container are cut from flat sheets of corrugated paper board. FIG. 1 shows a flat sheet having been cut to the requirements of the container body portion, indicated generally by the numeral 10. The body portion 10 is thus formed of a long narrow flat rectangular sheet of corrugated paper board. The width X of the body portion 10 defines the height of the container.

Figure 3:
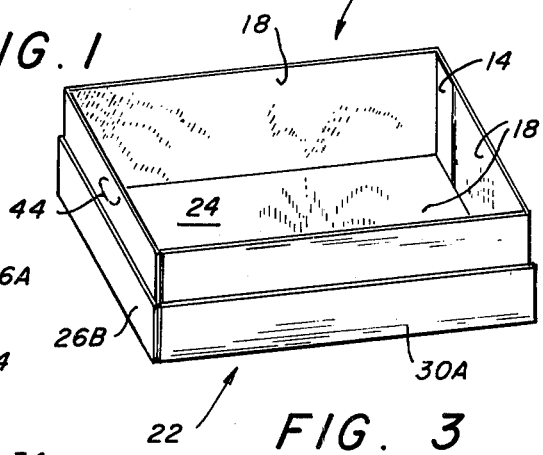
FIG. 3 shows the container partially completed with the body portion of FIG. 1 assembled and the bottom portion of FIG. 2 secured to the body portion.

The rectangular body portion 10 is scored at four places indicated by the numerals 12A through 12D. All the scoring is on lines parallel the ends. Scoring line 12D is adjacent one end of the body portion 10. When the body portion is folded along the scored lines, it forms an upright open top and open bottom container as shown in FIG. 3.

The portion of the body 10 between scoring line 12D and the adjacent end forms a sealing tab 14. All of one surface of the body portion 10 is covered by an insulating plastic foam sheet material 18 except tab receiving area 20 opposite the sealing tab 14. In forming the upright body of the container as shown in FIG. 3, tab 14 is glued to the tab receiving area 20.

Figure 2:
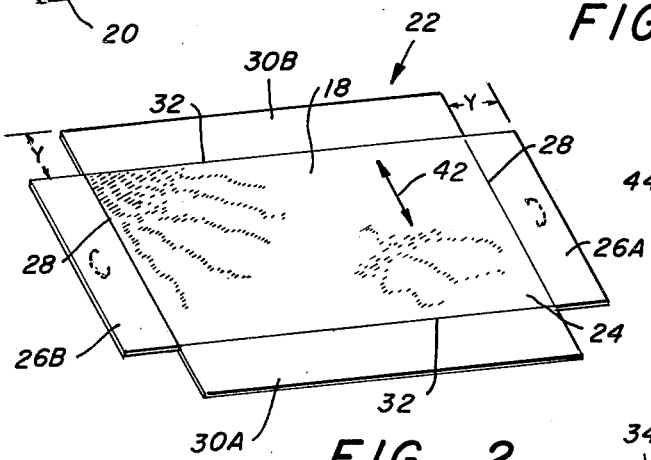
FIG. 2 is an isometric view of a bottom portion of the container as cut from a sheet of corrugated paper board and showing insulation applied to the central area. The basic container of this invention is constructed utilizing two corrugated paper boards cut in the shape of that of FIG. 2 and one cut in the shape of that of FIG. 1.

FIG. 2 is an isometric view of a bottom cover as formed from a flat sheet of corrugated paper board, the bottom cover being generally indicated by the numeral 22. The bottom cover 22 includes a rectangular center portion 24 having sheet foam insulating material 18 secured on one surface thereof. An integral end flap portion 26A and 26B is formed at each end of the center portion 24, the juncture of each end flap 26A and 26B being scored at 28 so that the end flaps may be bent perpendicular to the center portion 24. In like manner, integral side flap portions 30A and 30B are scored at 32 at the juncture with the center portion 24 to be folded perpendicular to the center portion. The end flaps 26A and 26B and side flaps 30A and 30B do not have insulation thereon. The width Y of the end flaps 26A and 26B and side flaps 30A and 30B is equal to one-half X, that is, one-half the height of the container body portion.

As previously stated, each container includes two of the portions as shown in FIG. 2, one serving as the top of the container and the other as the bottom.

In assembling the container the body portion 10 is first formed into an upright open top and open bottom container by bending the body portion at the scoring lines 12A, 12B, 12C and 12D. Sealing flap 14 is glued to the tab receiving portion 20. Next, the bottom portion 22 is affixed to the bottom of the body portion 10. Flaps 26A, 26B, 30A and 30B are all secured to the exterior surfaces of body portion 10 by the use of adhesive. In the condition as shown in FIG. 3, the container is ready to receive the deposit of perishables therein, such as dressed poultry, vegetables, fruit or the like.

Figure 4:
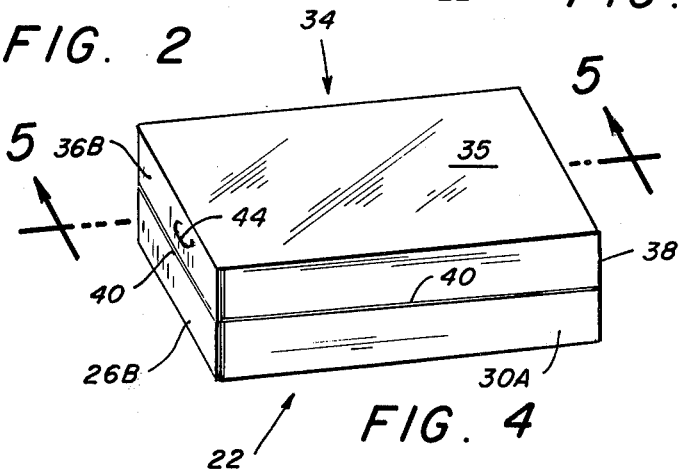
FIG. 4 is an isometric external view of the completed container, with the top and bottom portions in place.

After the container has been filled with its contents, which may include an addition of ice as a precaution to preserve the freshness of the perishable products, the top portion, generally indicated by numeral 34 in FIG. 4 is applied. The top portion is identical to the bottom portion of FIG. 2 and is applied in the same way, that is, by gluing the flaps to the exterior of the body portion 10. The flaps of the top 34 include end flaps 36A and 36B (see FIG. 5) and the side flaps, only one side flap 38 being shown in FIG. 4.

As the container is assembled as shown in FIG. 4, the outer edges of the end flaps and side flaps of the top portion contact the outer edges of the end flaps and side flaps of the bottom portion along the lines 40. Thus, the container has double thickness corrugated paper board along all vertical edges. This paper board is rendered specially rigid by the adhesive which secures the portions together. This extra strength, which is obtained in a simplicity and economy of construction, means that the container has the rigidity to permit stacking to a higher degree than other containers formed of the same weight corrugated paper. By the provision of the foam insulation 18 on all the interior surfaces the thermal efficiency of the container is improved so that it is particularly adaptable for use with food products which require refrigeration. In addition, when ice is placed with the products the foam insulation provides an impervious layer to prevent leakage of water formed by the melted ice. While the container is not intended to be capable of holding water it is substantially leakproof for a surprisingly long period of time. The corrugated paper board of which the container is formed is preferably of the type which is wax or oil coated so as to increase the water retaining capabilities and to maintain the strength of the container when subjected to water for a longer period of time.

Figure 5:
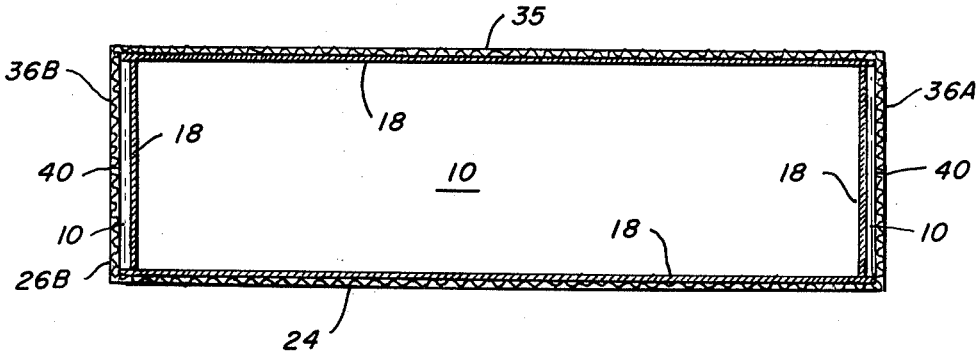
FIG. 5 is a cross-sectional view of the completely assembled container taken along the line 5-5 of FIG. 4.

FIG. 5 shows a cross-sectional view of the container in a fully assembled condition disclosing particularly the double thickness side walls which are provided for greatly increased strength and the insulation completely enclosing the interior of the container.

In cutting the portions of the container as shown in FIGS. 1 and 2 from flat sheets of corrugated paper board it is desirable that the portions be cut in such a way that the corrugations run in the direction indicated by the arrows 42 in FIGS. 1 and 2. When cut in this manner, the corrugations are vertical around the total perimeter of the body portion 10 in the assembled box. In addition, the corrugations are vertical in the bottom side flaps 30A and 30B and top side flaps 38. This provides maximum resistance against crushing of the container along the length of the sides.

If desired, a hand hold can be provided in the box by serrations indicated at 44 in FIGS. 1, 3 and 4. These are placed in portions of the body and in the side flaps 36A and 36B of the top portion. These serrations are formed in the corrugated paper board to outline the hand hold but the hand hold is not otherwise removed. The serrations do not extend through the foamed sheet insulation material 18 in any place so that the interior is not exposed to any opening to the container at the outside. When the hand holds are needed, the user merely pushes the portions outlined by the serrations 14 inwardly into the container so that a finger grip is provided without puncturing the foam plastic sheet 18. It has been stated that the top portion 34 of the container is identical to the bottom portion 22. This is true except for the provision of the serrations 44 outlining the hand holds which need not be placed in the container bottom portion 22.

The foam plastic material has been described as it is applied in sheet form, the sheet material being secured by adhesive to the container interior surfaces. It can be seen that the insulation material may be sprayed onto the appropriate surfaces of the container to achieve the same results.

The invention described fulfills all of the objectives initially set forth. The container is the ultimate of simplicity and economy, and has the maximum possible strength for a minimum amount of material. It is clean and sanitary and leaves no voids or unused spaces. It does not require the use of metal staples for assembly and provides an ideal container for the shipping of perishable products.

While the invention has been described with a certain degree of particularity it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

What is claimed is:

1. An improved shipping container comprising:

a body portion of corrugated paper board cut initially in the form of a long, narrow flat rectangle, the width of the rectangle defining the depth of the container, the flat rectangle being scored in four lines parallel the ends, one of the scored lines being adjacent one end defining a sealing tab, the body portion being folded along the scored lines forming an upright open bottom and open top rectangular container, the tab portion being glued to the inner end of the base portion opposite the tab end to retain the base portion in the rectangular configuration;

foam insulation secured to the surface of the body portion to cover all of one side of the body portion except an area adjacent the end opposite the end having the tab portion such that when the body portion is formed as an upright open bottom and open top rectangular container all interior surfaces are covered by insulation;

a top cover initially formed of a flat sheet of corrugated paper board including:

a. a rectangular center portion defining the length and width of the container;

b. an integral end flap portion at each end of the center portion of the same width of the center portion and of length equal to one-half of the depth of said body portion, each end flap being scored at the juncture with the center portion whereby the end flap portions may be folded perpendicular to the center portion; and c. an integral side flap portion at each side of the center portion of the same length of the center portion and of width equal to one-half of the depth of said body portion, each side flap being scored at the juncture with the center portion whereby the side flap portions may be folded perpendicular to the center portion;

a bottom cover identical to said top cover;

foam plastic insulation secured to one surface of said top and said bottom cover center portions;

the container being assembled such that the body portion is upright with the center portion of the top cover covering the upper open end of the body portion and the end flap and side flap portions secured by adhesive to the exterior of the body portion and in like manner, the center portion of the bottom cover covers the lower open end of the body portion and the end flap and die flap portions secured by adhesive to the exterior of the body portion, the edges of the end flaps and side flaps of the top cover contacting the edges of the end flaps and side flaps of the bottom cover, the assembled container thereby having all sides of double thickness of corrugated paper board secured by adhesive to each other, and wherein said body portion is formed in a manner such that in the assembled container the corrugations are vertical and wherein said top and bottom covers are such that the corrugations in said side flaps are vertical in the assembled container.

* * * * *